US012227385B2

(12) United States Patent
Uehara et al.

(10) Patent No.: US 12,227,385 B2
(45) Date of Patent: Feb. 18, 2025

(54) SHEET TRANSPORT DEVICE AND IMAGE FORMING APPARATUS

(71) Applicant: FUJIFILM Business Innovation Corp., Tokyo (JP)

(72) Inventors: Makio Uehara, Kanagawa (JP); Toshitaka Tanaka, Kanagawa (JP); Hiroyuki Momiyama, Kanagawa (JP); Masashi Matsumoto, Kanagawa (JP); Yusuke Itozaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 169 days.

(21) Appl. No.: 17/903,365

(22) Filed: Sep. 6, 2022

(65) Prior Publication Data

US 2023/0312284 A1 Oct. 5, 2023

(30) Foreign Application Priority Data

Mar. 29, 2022 (JP) ..... 2022-052972

(51) Int. Cl.
*B65H 7/02* (2006.01)
*B65H 5/06* (2006.01)

(52) U.S. Cl.
CPC ..... *B65H 7/02* (2013.01); *B65H 5/062* (2013.01); *B65H 2404/6111* (2013.01); *B65H 2513/11* (2013.01); *B65H 2515/32* (2013.01); *B65H 2801/06* (2013.01)

(58) Field of Classification Search
CPC .. B65H 7/02; B65H 5/062; B65H 2404/6111; B65H 2513/11; B65H 2515/32; B65H 2801/06
See application file for complete search history.

(56) References Cited

U.S. PATENT DOCUMENTS 10,710,829 B2 7/2020 Yamaguchi et al.
2019/0317586 A1* 10/2019 Ohnishi ..... G06F 1/3287
2020/0369483 A1* 11/2020 Itoh ..... B65H 5/062

FOREIGN PATENT DOCUMENTS

CN 101320233 * 12/2008
JP 2019-99372 A 6/2019

OTHER PUBLICATIONS

Machine translation of CN 101320233. (Year: 2008).*

* cited by examiner

*Primary Examiner* — Thomas A Morrison
(74) *Attorney, Agent, or Firm* — Oliff PLC

(57) ABSTRACT

A sheet transport device includes: a curved sheet transport path; multiple transport roller pairs disposed in the sheet transport path; multiple driving sources that drive the multiple transport roller pairs; multiple load detectors that detect the loads of the multiple driving sources; and a control unit that controls the driving speed of at least one of the driving sources such that detection results obtained by the load detectors are within a predetermined range in accordance with the position of the leading end of a sheet.

16 Claims, 12 Drawing Sheets

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2022-052972 filed Mar. 29, 2022.

BACKGROUND

(i) Technical Field

The present disclosure relates to a sheet transport device and an image forming apparatus.

(ii) Related Art

Japanese Unexamined Patent Application Publication No. 2019-99372 discloses a technique related to a paper transport device.

The system disclosed therein includes: an upstream roller and a downstream roller provided at a distance from each other in a sheet transport path; sheet transport guides disposed on both sides, in the thickness direction, of a sheet transported along the sheet transport path, at a position between the upstream and downstream rollers; driving units that independently drive the upstream and downstream rollers; load-torque acquisition units that acquire the load torque of the upstream and downstream rollers; a determination unit that determines whether or not the sheet is rubbed against the sheet transport guides from the magnitude of the load torque of the upstream and downstream rollers acquired by the load-torque acquisition units; and a control unit that controls transportation of the sheet corresponding to the load torque of the upstream and downstream rollers on the basis of the result of determination by the determination unit.

SUMMARY

Aspects of non-limiting embodiments of the present disclosure relate to reducing damage to a sheet, compared with a configuration in which the driving speeds of multiple transport roller pairs are controlled together, regardless of the position of the leading end of the sheet.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet transport device including: a curved sheet transport path; multiple transport roller pairs disposed in the sheet transport path; multiple driving sources that drive the multiple transport roller pairs; multiple load detectors that detect the loads of the multiple driving sources; and a control unit that controls the driving speed of at least one of the driving sources such that detection results obtained by the load detectors are within a predetermined range in accordance with the position of the leading end of a sheet.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
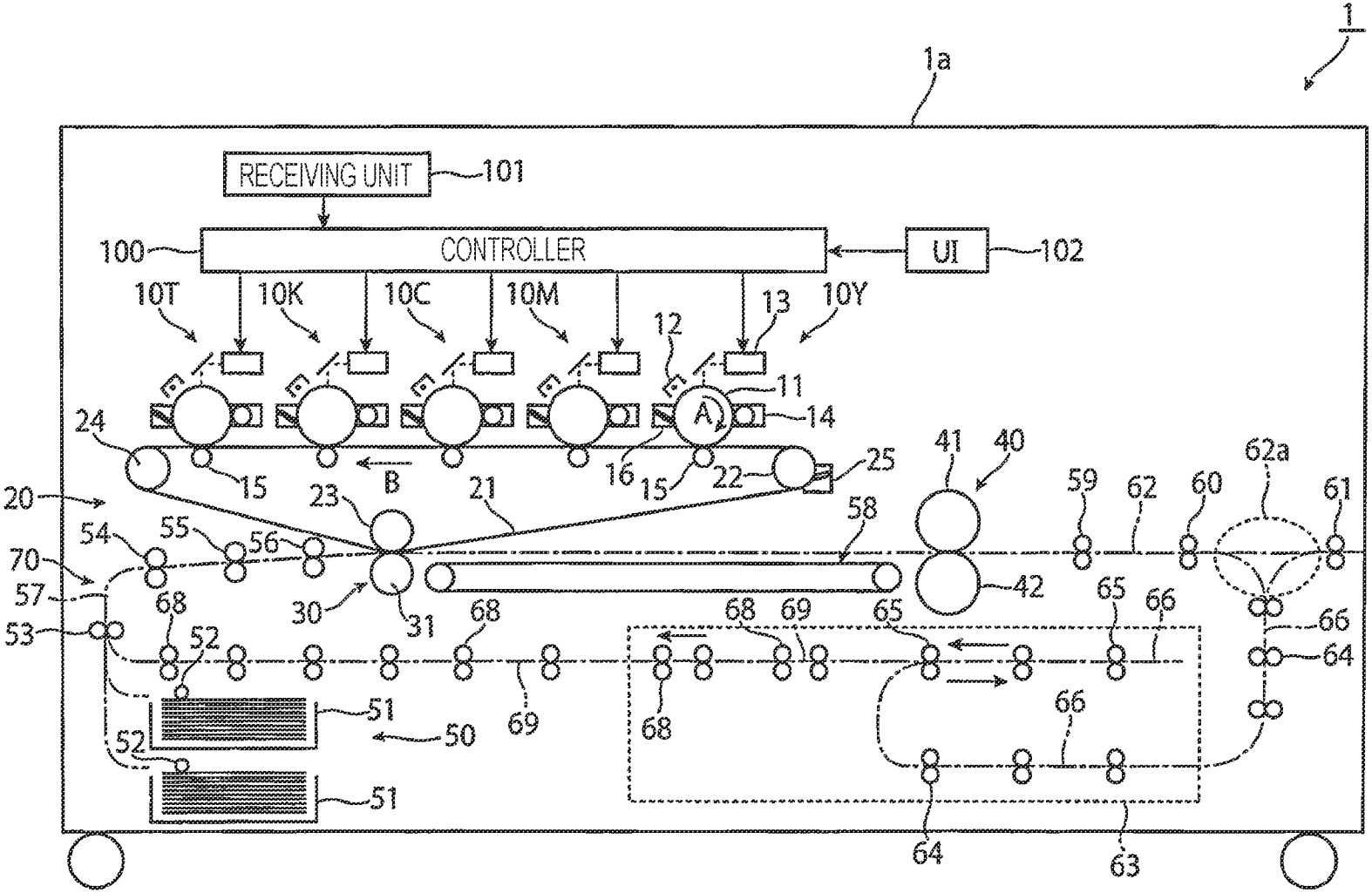
FIG. 1 shows the overall structure of an image forming apparatus that employs a sheet transport device according to a first exemplary embodiment of the present disclosure.

FIG. 1 shows the overall structure of an image forming apparatus that employs a sheet transport device according to a first exemplary embodiment of the present disclosure.

Overall Configuration of Image Forming Apparatus

An image forming apparatus 1 according to the first exemplary embodiment is, for example, a color printer. As shown in FIG. 1, the image forming apparatus 1 includes: multiple image forming devices 10 that form toner images developed by toner, serving as developer; an intermediate transfer device 20 that holds the toner images formed by the image forming devices 10 and transports the toner images to a second transfer position, where the toner images are eventually second-transferred to a recording sheet 5, serving as a recording medium (sheet); a paper feeder 50 that stores and transports recording sheets 5 to be supplied to the second transfer position in the intermediate transfer device 20; and a fixing device 40 that fixes the toner image second-transferred to the recording sheet 5 by the intermediate transfer device 20. The image forming apparatus 1 includes a device body 1*a*. The device body 1*a* includes a support structural member and an exterior cover. One-dot chain lines in FIG. 1 show transport paths in the device body 1*a*, along which a recording sheet 5 is transported. In the first exemplary embodiment, the multiple image forming devices 10, the intermediate transfer device 20, and the fixing device 40 constitute an image forming section.

The image forming devices 10 include five image forming devices 10Y, 10M, 10C, 10K, and 10T, which form yellow (Y), magenta (M), cyan (C), black (K), and transparent (T) toner images, respectively. The five image forming devices 10 (Y, M, C, K, T) are arranged side-by-side in the horizontal direction inside the device body 1*a*.

Figure 2:
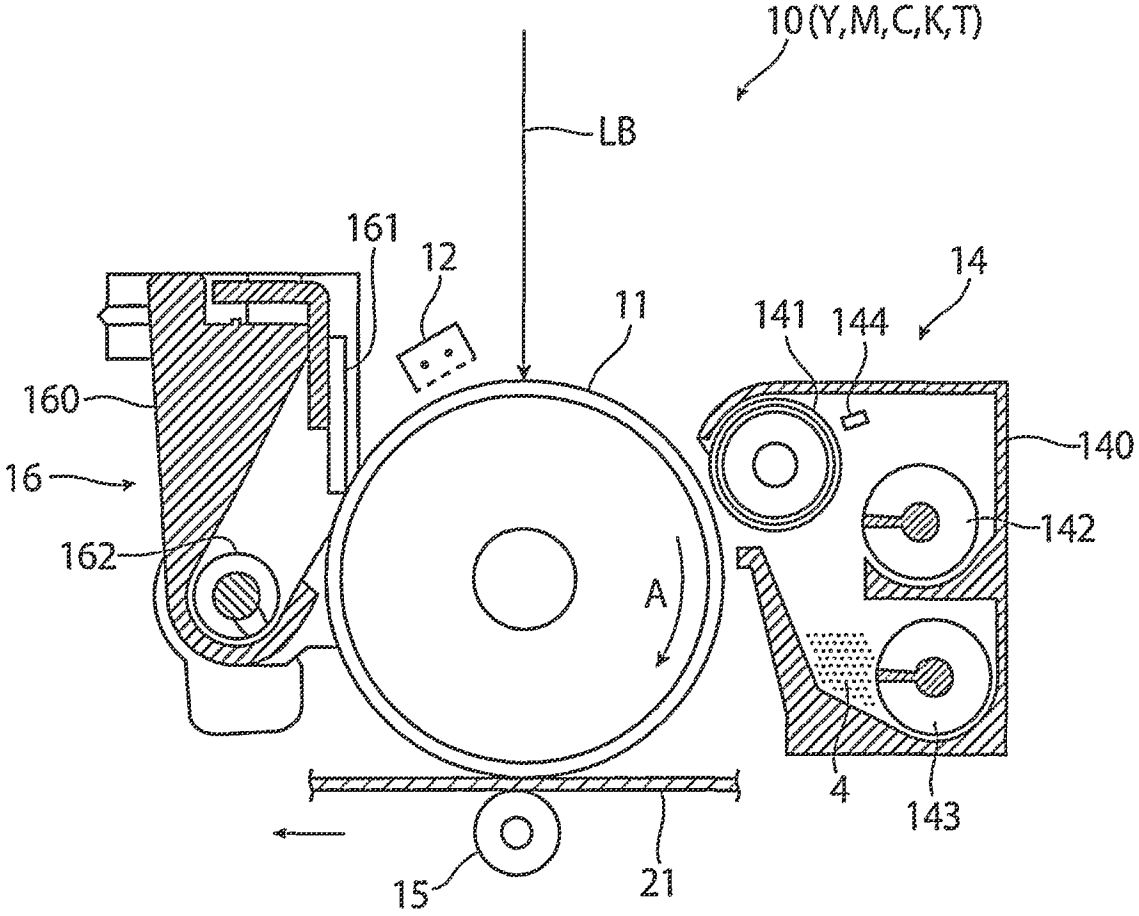
FIG. 2 shows the structure of an image forming device of the image forming apparatus according to the first exemplary embodiment of the present disclosure.

As shown in FIG. 2, the image forming devices 10 (Y, M, C, K, T) each include a rotary photoconductor drum 11, serving as an image carrier. The photoconductor drum 11 is surrounded by: a charging device 12 that charges the circumferential surface (image carrying surface on which an image is to be formed) of the photoconductor drum 11 to a required electric potential; an exposure device 13 that radiates light onto the charged circumferential surface of the photoconductor drum 11 on the basis of image information (signal) to form an electrostatic latent image (for the corresponding color) having a potential difference; a developing device 14 (Y, M, C, K, T), serving as a developing unit, that develops the electrostatic latent image into a toner image with the toner in the developer of the corresponding color (Y, M, C, K, T); a first transfer device 15 (Y, M, C, K, T) that transfers the toner image to the intermediate transfer device 20; a drum cleaner 16 (Y, M, C, K, T) that removes a deposited substance, such as residual toner deposited on the image carrying surface of the photoconductor drum 11 after the first transfer, to clean the photoconductor drum 11.

The photoconductor drum 11 includes a grounded cylindrical or columnar base member and an image carrying surface formed on the circumferential surface thereof, the image carrying surface having a photoconductive layer (photosensitive layer) made of a photosensitive material. The photoconductor drum 11 is supported so as to be rotated in the arrow A direction by receiving a driving force from a driving unit (not shown).

The charging device 12 is a scorotron charger disposed at a distance from the photoconductor drum 11. A charging voltage is supplied to the charging device 12. The charging voltage is a voltage or a current with the same polarity as the charging polarity of the toner to be supplied from the developing device 14, when the developing device 14 performs reversal development. The charging device 12 may of course be a contact-type charging roller or the like, which is disposed in contact with the photoconductor drum 11.

The exposure device 13 performs deflection scanning of a laser beam LB corresponding to image information in the axial direction of the photoconductor drum 11. The exposure device 13 may be an LED print head that radiates light corresponding to the image information onto the photoconductor drum 11 with light-emitting diodes (LEDs), serving as multiple light-emitting elements, arranged along the axial direction of the photoconductor drum 11 to form an electrostatic latent image.

The developing devices 14 (Y, M, C, K, T) each include a housing 140 having a developer storage chamber and an opening at a position facing the photoconductor drum 11. The housing accommodates: a developing roller 141 that holds and transports the developer to a developing region facing the photoconductor drum 11; a stirring supply member 142, such as a screw auger or the like, that supplies, while stirring, the developer through the developing roller 141; a stirring transport member 143, such as a screw auger or the like, that transports, while stirring, the developer to the stirring supply member 142; a layer-thickness restricting member 144 that restricts the amount of developer (layer thickness) held on the developing roller 141; and the like. A power supply device (not shown) supplies a developing voltage between the photoconductor drum 11 and the developing roller 141 in the developing device 14. The five color developers are, for example, two-component developers each including a non-magnetic toner and a magnetic carrier.

The first transfer device 15 (Y, M, C, K, T) is a contact-type transfer device including a first transfer roller that is opposed to the circumference of the photoconductor drum 11 with an intermediate transfer belt 21 therebetween and rotates. The first transfer roller receives, from a power supply device (not shown), the supply of a first transfer voltage, which is a direct-current voltage with the opposite polarity to the charging polarity of the toner.

The drum cleaner 16 includes: a container-shaped body 160 having an opening; a cleaning plate 161 disposed in contact, at a certain pressure, with the circumferential surface of the photoconductor drum 11 after the first transfer to remove a deposited substance, such as residual toner; and a delivery member 162, such as a screw auger, that recovers the deposited substance, such as the toner, removed with the cleaning plate 161 and transports the deposited substance to a recovery system (not shown). The cleaning plate 161 is a plate-like member (for example, blade) made of, for example, rubber.

As shown in FIG. 1, the intermediate transfer device 20 is disposed below the image forming devices 10 (Y, M, C, K, T) in the vertical direction. The intermediate transfer device 20 basically includes: the intermediate transfer belt 21 that revolves in the arrow B direction while passing through the first transfer positions located between the photoconductor drums 11 and the first transfer devices 15 (first transfer rollers); multiple belt-support rollers 22 to 24 that support the intermediate transfer belt 21 in a desired state from the inside thereof in a manner allowing rotation thereof; a second transfer device 30, serving as an example of a second transfer part, that is disposed on the outer circumferential surface (image carrying surface) of a portion of the intermediate transfer belt 21 supported by the belt-support roller 23 and that second-transfers a toner image on the intermediate transfer belt 21 to a recording sheet 5; and a belt cleaner 25 that removes the deposited substance, such as toner and paper dust, remaining on the outer circumferential surface of the intermediate transfer belt 21 after passing through the second transfer device 30.

The intermediate transfer belt 21 is an endless belt made of, for example, a synthetic resin, such as polyimide resin or polyamide resin, and a resistance adjuster, such as carbon black, dispersed therein. The belt-support roller 22 serves as an opposing roller for the belt cleaner 25, as well as a driving roller that is rotationally driven by a driving device (not shown). The belt-support roller 23 serves as an opposing roller for the second transfer device 30. The belt-support roller 24 serves as a surface forming roller that forms an image forming surface of the intermediate transfer belt 21.

As shown in FIG. 1, the second transfer device 30 is a contact-type transfer device including a second transfer roller 31, to which a second transfer voltage is supplied. The second transfer roller 31 is in contact with and rotates on the circumferential surface of the intermediate transfer belt 21 at the second transfer position, which is an outer-circumferential-surface portion of the intermediate transfer belt 21 supported by the belt-support roller 23 in the intermediate transfer device 20. A power supply device (not shown) supplies, to the second transfer roller 31 or the belt-support roller 23 of the intermediate transfer device 20, a direct-current voltage, serving as a second transfer voltage, with the same polarity as or the opposite polarity to the charging polarity of the toner.

The fixing device 40 includes: a housing (not shown) having entry and exit ports for a recording sheet 5; a roller- or belt-type heating rotary member 41 that rotates in the counterclockwise direction and that is heated by a heating part such that the surface temperature thereof is maintained at a predetermined temperature; and a roller- or belt-type pressure rotary member 42 extending substantially in the axial direction of the heating rotary member 41 and in contact with the heating rotary member 41 at a predetermined pressure so as to be rotated in a driven manner. In the fixing device 40, the contact portion between the heating rotary member 41 and the pressure rotary member 42 serves as a fixing part, where necessary fixing processing (heating and pressing) is performed.

The paper feeder 50 is disposed below the image forming devices 10 (Y, M, C, K, T) and the intermediate transfer device 20. The paper feeder 50 includes one or more paper storage bodies 51 that accommodate a stack of recording sheets 5 of a desired size and type, and sending devices 52 that send out the recording sheets 5 one-by-one from the paper storage bodies 51. For example, the paper storage bodies 51 are attached to the device body 1*a* such that a user can pull out the paper storage bodies 51 to the front side (i.e., the side surface to which the user faces when operating the apparatus) of the device body 1*a*.

Examples of the recording sheets 5 include normal paper, thin paper, such as tracing paper, and overhead projector (OHP) sheets for electrophotographic copiers, printers, and the like. For even better smoothness of the image surface after fixing, it is desirable that the recording sheets 5 have as smooth surfaces as possible, and, for example, so-called thick paper having a relatively large grammage, such as coated paper formed by coating the surface of normal paper with resin or the like, art paper for printing, and the like, is also suitable.

As the needs are diversified these days, gold-color paper and silver-color paper having metallic (gold color, silver color, etc.) surfaces, and specialty recording media (hereinbelow, "specialty paper"), such as OHP sheets and coated paper having glossy surfaces, are used as the recording sheets 5. The specialty paper has a metallic surface or a glossy surface and is more likely to be degraded when the surface thereof gets a faint scratch, a cut mark, or the like before or after image forming, compared with normal paper.

A feeding transport path 57 including multiple paper-transport roller pairs 53 to 56, which transport a recording sheet 5 fed out of the paper feeder 50 to the second transfer position, and transport guides (not shown) is provided between the paper feeder 50 and the second transfer device 30. The paper-transport roller pair 56 disposed at a position immediately before the second transfer position in the feeding transport path 57 serves as, for example, rollers (registration rollers) for adjusting the transport timing of a recording sheet 5. A sheet transport belt 58 is provided between the second transfer device 30 and the fixing device 40 to transport, to the fixing device 40, the recording sheet 5 transported from the second transfer device 30 after the second transfer. An output transport path 62 including sheet output roller pairs 59 to 61, which discharge the recording sheet 5 transported from the fixing device 40 after fixing to a sheet output part (not shown) provided on a side surface of the device body 1*a*, is provided near a sheet output port formed in the device body 1*a* of the image forming apparatus 1.

The image forming apparatus 1 also includes a duplex unit 63 for forming images on both sides of a recording sheet 5. Instead of transporting the recording sheet 5 having an image formed on one side thereof to the sheet output part (not shown) with the sheet output roller pairs 59 to 61, the duplex unit 63 switches the sheet transport direction to the lower side with a transport-path switching part 62*a* provided downstream of the sheet output roller pair 60 to guide the recording sheet 5 to a reverse transport path 66 including multiple reverse transport roller pairs 64 and 65. The forward rotation and reverse rotation of the reverse transport roller pair 65 can be switched. The reverse transport path 66 of the duplex unit 63 is connected to a duplex transport path 69 including multiple paper-transport roller pairs 68 via a duplex transport path 67. The recording sheet 5 transported to the reverse transport path 66 of the duplex unit 63 is transported again to the feeding transport path 57 via the duplex transport path 69.

FIG. 1 shows a controller 100 that generally controls the operation of the image forming apparatus 1. The controller 100 includes a central processing unit (CPU, not shown), a read-only memory (ROM), a random-access memory (RAM), a bus connecting the CPU, ROM, and the like, and a communication interface. A receiving unit 101 receives image information transmitted from an external host device, such as a personal computer, or an image reading device. A user interface 102 allows a user to input and set various conditions when the user operates the image forming apparatus 1. The user interface 102 includes a liquid crystal display panel or the like, via which the user sets various conditions and which displays messages and the like to the user.

Operation of Image Forming Apparatus

A basic image forming operation of the image forming apparatus 1 will be described.

A full-color-mode operation, in which the five image forming devices 10 (Y, M, C, K, T) form a full-color image composed of five color (Y, M, C, K, T) toner images, will be described below.

When the image forming apparatus 1 receives image information and instruction information of a full-color-image forming operation (printing) request from a host device, such as a personal computer, or an image reading device (not shown), the controller 100 actuates the five image forming devices 10 (Y, M, C, K, T), the intermediate transfer device 20, the second transfer device 30, the fixing device 40, and the like.

As shown in FIGS. 1 and 2, in the image forming devices 10 (Y, M, C, K, T), first, the photoconductor drums 11 rotate in the arrow A direction, and the charging devices 12 charge the surfaces of the photoconductor drums 11 to a certain electric potential and a certain polarity (negative polarity in the first exemplary embodiment). Next, the exposure devices 13 radiate light emitted on the basis of image signals corresponding to color components (Y, M, C, K, T) onto the charged surfaces of the photoconductor drums 11 to form, on the surfaces thereof, electrostatic latent images corresponding to the respective color components and having certain potential differences.

Next, the developing devices 14 supply, with the developing rollers 141, toners of the respective colors (Y, M, C, K, T) charged with a certain polarity (negative polarity) to the corresponding electrostatic latent images formed on the photoconductor drums 11. The toners are electrostatically adhered to the electrostatic latent images to develop the electrostatic latent images. As a result, the electrostatic latent images formed on the photoconductor drums 11 are developed as five color toner images (Y, M, C, K, T), which have been developed with the toners of the corresponding colors.

Next, the color toner images formed on the photoconductor drums 11 of the image forming devices 10 (Y, M, C, K, T) are transported to the first transfer positions, where the first transfer devices 15 (Y, M, C, K, T) first-transfer the color toner images to the intermediate transfer belt 21, revolving in the arrow B direction, of the intermediate transfer device 20 such that the color toner images are sequentially superposed on one another.

In the image forming devices 10 (Y, M, C, K, T) after the first transfer, the drum cleaners 16 scrape off and remove the deposited substance to clean the surfaces of the photoconductor drums 11. By doing so, the image forming devices 10 (Y, M, C, K, T) can be used in the next image forming operation.

Next, in the intermediate transfer device 20, the revolving intermediate transfer belt 21 transports the first-transferred toner images held thereon to the second transfer position. Meanwhile, the paper feeder 50 feeds a recording sheet 5 into the feeding transport path 57 in accordance with the image forming operation. In the feeding transport path 57, the paper-transport roller pair 56, serving as registration rollers, feeds the recording sheet 5 to the second transfer position in accordance with the transfer timing.

At the second transfer position, the second transfer device 30 second-transfers the toner images on the intermediate transfer belt 21 together to the recording sheet 5. In the intermediate transfer device 20 after the second transfer, the belt cleaner 25 cleans the intermediate transfer belt 21 by removing the deposited substance, such as toner remaining on the surface of the intermediate transfer belt 21 after the second transfer.

The recording sheet 5 having the toner images second-transferred thereto is separated from the intermediate transfer belt 21 and is transported to the fixing device 40 via the sheet transport belt 58. In the fixing device 40, the recording sheet 5 after the second transfer is allowed to pass through the contact portion formed between the heating rotary member 41 and the pressure rotary member 42 rotating against each other, whereby necessary fixing processing (heating and pressing) is performed to fix the unfixed toner image to the recording sheet 5. Finally, the recording sheet 5 after fixing is discharged to the sheet output part (not shown) provided, for example, on the side surface of the device body 1*a* by the sheet output roller pairs 59 to 61.

When images are to be formed on both sides of a recording sheet 5, instead of directly discharging the recording sheet 5 having an image on one side thereof to the sheet output part (not shown) via the output transport path 62, the sheet transport direction is switched to the lower side with the transport-path switching part 62*a* to transport the recording sheet 5 to the reverse transport path 66 in the duplex unit 63. The reverse transport roller pair 65 switches the transport direction of the recording sheet 5 transported to the reverse transport path 66 in the duplex unit 63, and the recording sheet 5 is transported again to the feeding transport path 57 via the duplex transport path 69. After toner images have been transferred to the back surface of the recording sheet 5 at the second transfer position in the intermediate transfer device 20, the recording sheet 5 goes through the fixing processing in the fixing device 40 and is then discharged to the sheet output part (not shown) provided on the side surface of the device body 1*a* by the sheet output roller pairs 59 to 61.

Through this operation, the recording sheet 5 having a full-color image composed of five color toner images is output.

Configuration of Sheet Transport Device

Figure 3:
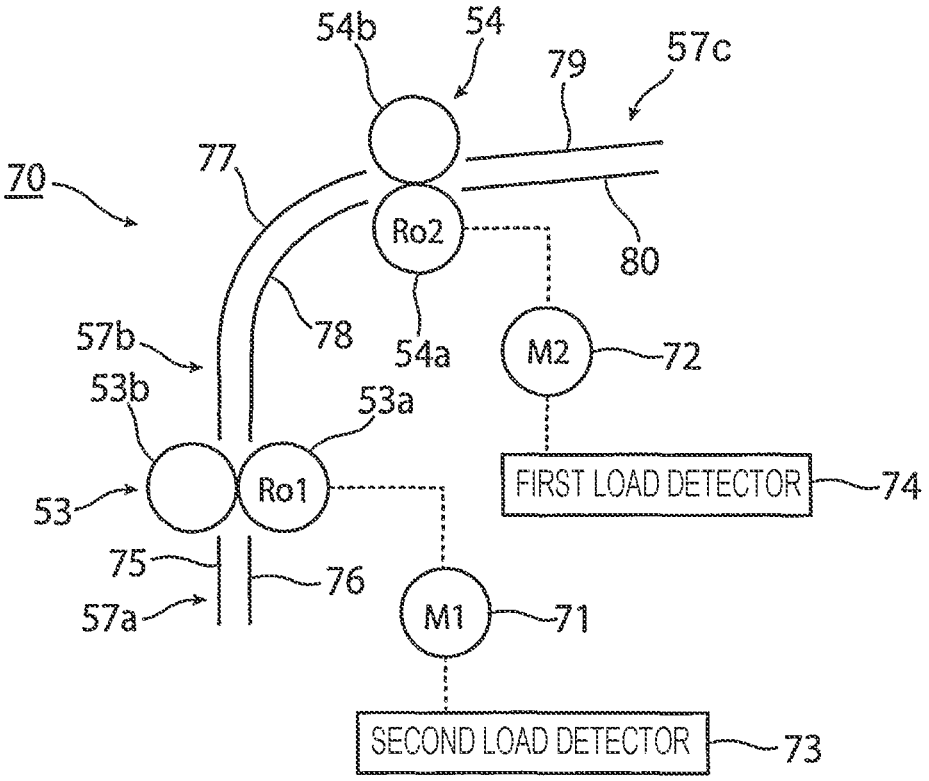
FIG. 3 shows the structure of the relevant part of the sheet transport device according to the first exemplary embodiment of the present disclosure.

FIGS. 1 and 3 show the structure of the image forming apparatus that employs the paper transport device, serving as an example of a sheet transport device, according to the first exemplary embodiment of the present disclosure.

As shown in FIGS. 1 and 3, the paper transport device 70 according to the first exemplary embodiment includes: the paper-transport roller pairs 53 and 54, serving as an example of multiple transport roller pairs, arranged adjacent to each other along a curved transport path for a recording sheet 5, serving as an example of a sheet; first and second driving motors 71 and 72, serving as an example of multiple driving sources, that drive the paper-transport roller pairs 53 and 54; and first and second load detectors 73 and 74 that detect the loads of the first and second driving motors 71 and 72.

The first and second load detectors 73 and 74 detect the loads of the first and second driving motors 71 and 72 by detecting, for example, the driving currents of the first and second driving motors 71 and 72, respectively. The first and second load detectors 73 and 74 are, for example, rotary encoders or the like that detect the rotational speeds of the first and second driving motors 71 and 72 and the paper-transport roller pairs 53 and 54 and detect the load by detecting changes in the rotational speeds of the first and second driving motors 71 and 72 and the paper-transport roller pairs 53 and 54, or torque sensors that detect the load torques. The first and second load detectors 73 and 74 may of course be any other devices that can detect the loads of the first and second driving motors 71 and 72.

As shown in FIG. 3, the paper-transport roller pairs 53 and 54 are arranged along a curved transport path of the feeding transport path 57. The feeding transport path 57 includes: a linear first transport path 57*a* along which a recording sheet 5 fed from the paper feeder 50 is transported vertically upward; a second transport path 57*b* curved to the right so as to extend in the horizontal direction from the upper end of the linear first transport path; and a linear third transport path 57*c* extending in the horizontal direction from the end of the second transport path 57*b*.

The first transport path 57*a* of the feeding transport path 57 includes planar first guide members 75 and 76 that guide the front and back surfaces of a recording sheet 5, respectively, and the first paper-transport roller pair 53 disposed at an intermediate position of the first guide members 75 and 76. The second transport path 57*b* of the feeding transport path 57 includes curved-plate-like second guide members 77 and 78 having a certain radius of curvature, for guiding the front and back surfaces of the recording sheet 5, respectively, and the second paper-transport roller pair 54 disposed at the ends of the second guide members 77 and 78. The third transport path 57*c* of the feeding transport path 57 includes planar third guide members 79 and 80 that guide the front and back surfaces of the recording sheet 5, respectively, and paper-transport roller pairs 55 and 56 disposed at intermediate positions of the third guide members 79 and 80.

Herein, the front surface of the recording sheet 5 is the side of the recording sheet 5 to which a toner image is to be transferred at the second transfer position in the intermediate transfer device 20, after the recording sheet 5 has been fed out of the paper feeder 50 and transported along the feeding transport path 57. The back surface of the recording sheet 5 is the reverse side from the front surface.

The first paper-transport roller pair 53 includes a driving roller 53*a* driven by a first driving motor 71, and a driven roller 53*b* that is rotated in a driven manner by being pressed against the driving roller 53*a* or receiving a driving force from the driving roller 53*a*. The second paper-transport roller pair 54 includes a driving roller 54*a* driven by a second driving motor 72 and a driven roller 54*b* that is rotated in a driven manner by being pressed against the driving roller 54*a* or receiving a driving force from the driving roller 54*a*. Although FIG. 3 shows a configuration in which the driving rollers 53*a* and 54*a* of the first and second paper-transport roller pairs 53 and 54 are disposed on the back-surface side, and the driven rollers 53*b* and 54*b* are disposed on the front-surface side of the recording sheet 5, the driven rollers 53*b* and 54*b* may be disposed on the back-surface side, and the driving rollers 53*a* and 54*a* may be disposed on the front-surface side of the recording sheet 5.

The loads of the first and second driving motors 71 and 72 detected by the first and second load detectors 73 and 74 are input to the controller 100. The controller 100 monitors the load data of the first and second driving motors 71 and 72 detected by the first and second load detectors 73 and 74 at predetermined sampling intervals (period). Desirably, the sampling interval is set to a value lower than or equal to the clock cycle of the first and second driving motors 71 and 72 and, thus, is set to, for example, about 0.1-1.0 ms.

In the thus-configured paper transport device 70, if the recording-sheet transport speed of the paper-transport roller pairs 53 and 54 varies or changes, at least one of the front and back surfaces of the recording sheet 5 may come into contact with or be rubbed by the guide members 77 and 78, or the like of the feeding transport path 57.

Figure 4:
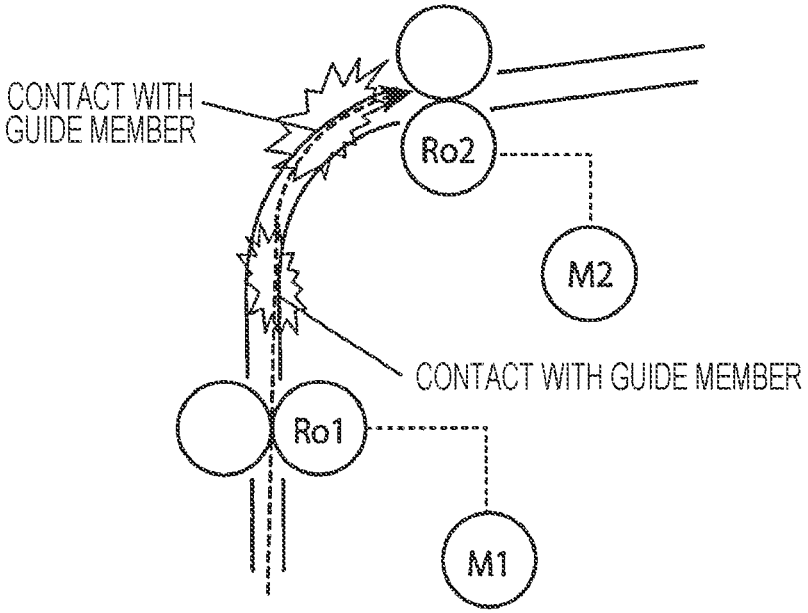
FIG. 4 shows a transport state of a recording sheet.

More specifically, as shown in FIG. 4, when a recording sheet 5 with a curled leading end 5*a* is transported, while the leading end 5*a* is transported from the paper-transport roller pair 53 to the paper-transport roller pair 54, at least one of the front and back surfaces of the recording sheet 5 may come into contact with and be rubbed by the guide members 77 and 78, or the like of the feeding transport path 57, or at least one of the front and back surfaces of the recording sheet 5 may come into contact with the guide member 77 of the feeding transport path 57 and then with the guide member 78 opposite thereto.

Figure 5:
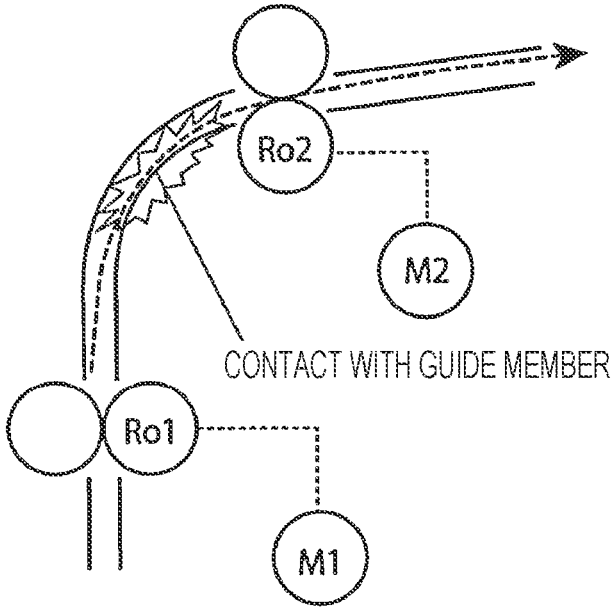
FIG. 5 shows a transport state of a recording sheet.

After the leading end 5*a* of the recording sheet 5 has been transported from the paper-transport roller pair 53 to the paper-transport roller pair 54, as shown in FIG. 5, the back surface of the recording sheet 5 may come into contact with the guide member 78 of the feeding transport path 57, or the front surface of the recording sheet 5 may come into contact with the guide member 77 of the feeding transport path 57 due to, for example, a difference in the sheet transport speed between the paper-transport roller pairs 53 and 54. Moreover, after the leading end 5*a* of the recording sheet 5 has passed through the paper-transport roller pair 53, the back surface of the recording sheet 5 may come into contact with the guide member 78 of the feeding transport path 57 again.

When the recording sheet 5 is normal paper, contact between at least one of the front and back surfaces of the recording sheet 5 and the guide members 77 and 78 of the feeding transport path 57 is not a serious issue. However, when the recording sheet 5 is specialty paper, such as metallic or glossy paper, contact with the guide members 77 and 78 is likely to cause a linear scratch on the front and back surfaces of the specialty paper, degrading the quality of the specialty paper, which is problematic.

To counter this problem, the paper transport device 70 according to the first exemplary embodiment includes the controller 100, serving as an example of a control unit, that controls the driving speed of at least one of the multiple driving sources such that detection results obtained by the load detectors are within a predetermined range in accordance with the leading end position of the recording sheet 5.

Specifically, as shown in FIGS. 1 and 3, in the image forming apparatus 1 that employs the paper transport device 70 according to the first exemplary embodiment, the controller 100 determines whether the leading end 5*a* of the recording sheet 5 is located between the paper-transport roller pairs 53 and 54 or has passed through the paper-transport roller pair 54. Then, the controller 100 performs rough adjustment, in which the rotational speeds of the first and second driving motors 71 and 72 are roughly controlled in accordance with the position of the leading end 5*a* of the recording sheet 5, and fine adjustment, in which the rotational speeds of the first and second driving motors 71 and 72 are finely controlled in accordance with the position of the leading end 5*a* of the recording sheet 5.

The controller 100 detects the loads of the first and second driving motors 71 and 72 with the first and second load detectors 73 and 74 and calculate predetermined multiple parameters, such as the rates of change of the loads of the first and second driving motors 71 and 72, on the basis of the loads of the first and second driving motors 71 and 72 detected by the first and second load detectors 73 and 74.

The controller 100 controls the rotational speeds of the first and second driving motors 71 and 72 in accordance with the loads of the first and second driving motors 71 and 72 and the rate of change thereof.

Operation of Paper Transport Device

The paper transport device 70 according to the first exemplary embodiment suppresses damage to a sheet, in contrast to the case where the driving speeds of multiple transport roller pairs are controlled together regardless of the position of the leading end of the sheet.

Specifically, as shown in FIG. 1, in the paper transport device 70 according to the first exemplary embodiment, when an image forming operation is started by the controller 100, the paper feeder 50 starts to feed a recording sheet 5, and the recording sheet 5 is transported along the feeding transport path 57 to the second transfer position in the intermediate transfer device 20.

Figure 6:
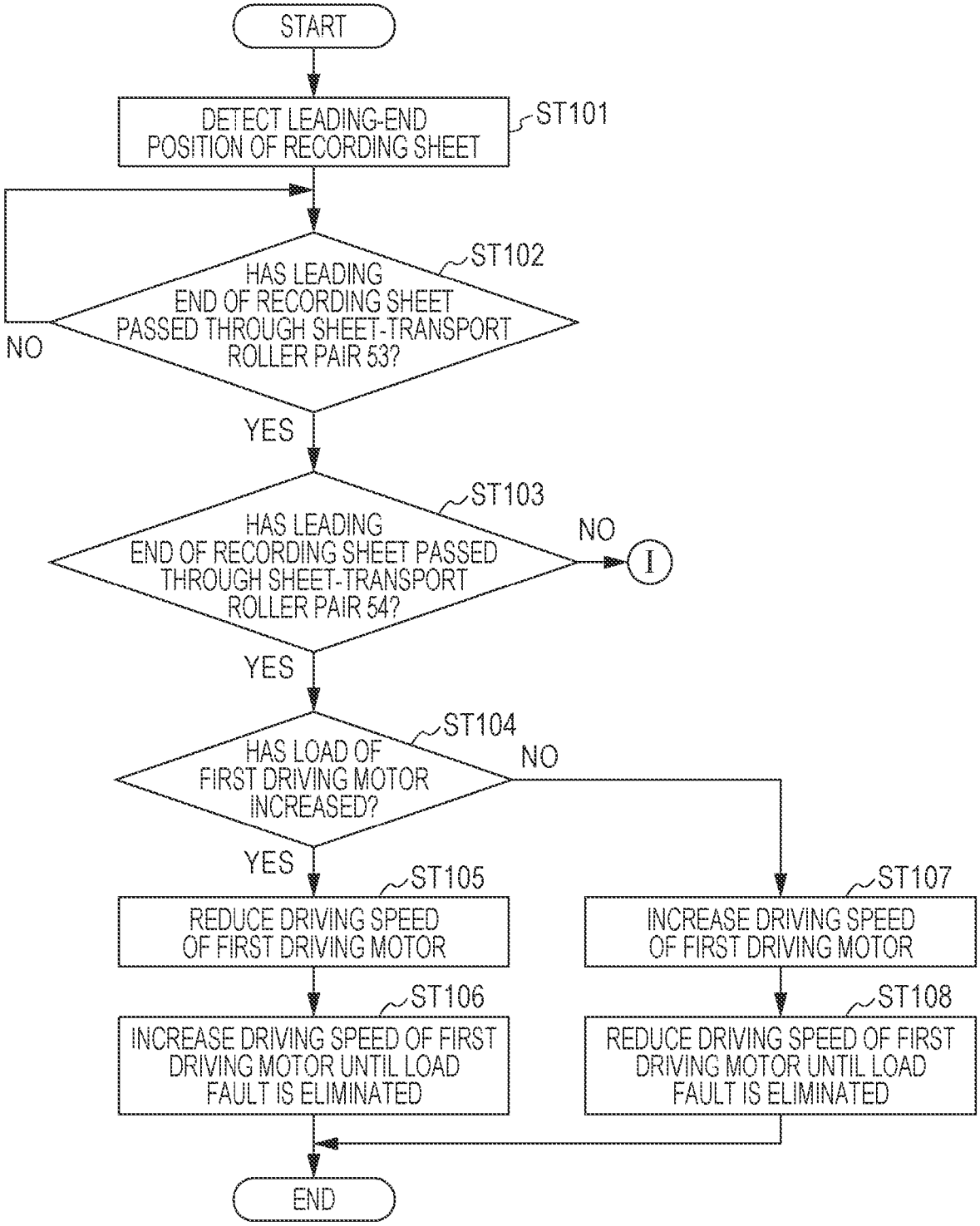
FIG. 6 is a flowchart showing an operation of the sheet transport device according to the first exemplary embodiment of the present disclosure.
Figure 7A:
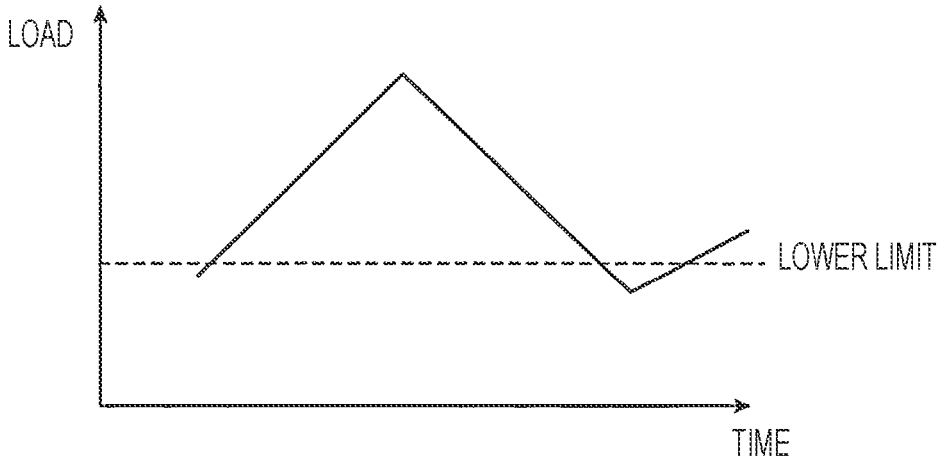
FIGS. 7A and 7B are graphs showing changes in the load of a driving motor.
Figure 7B:
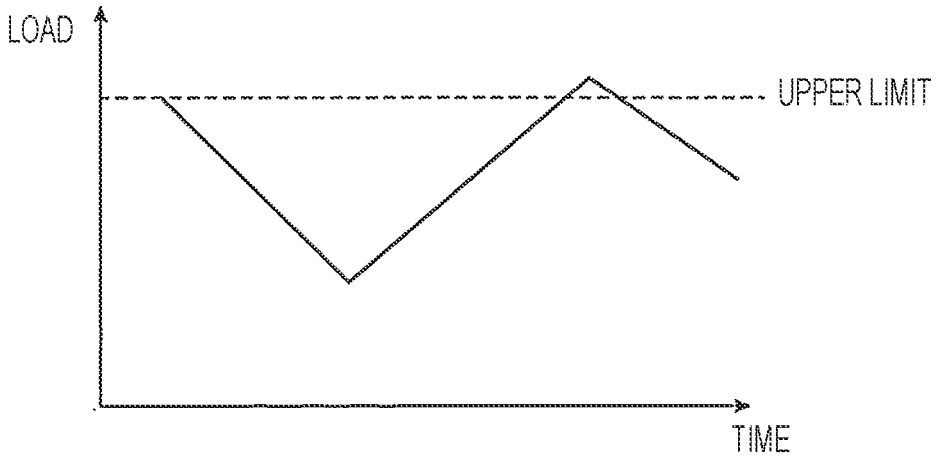
Figure 8:
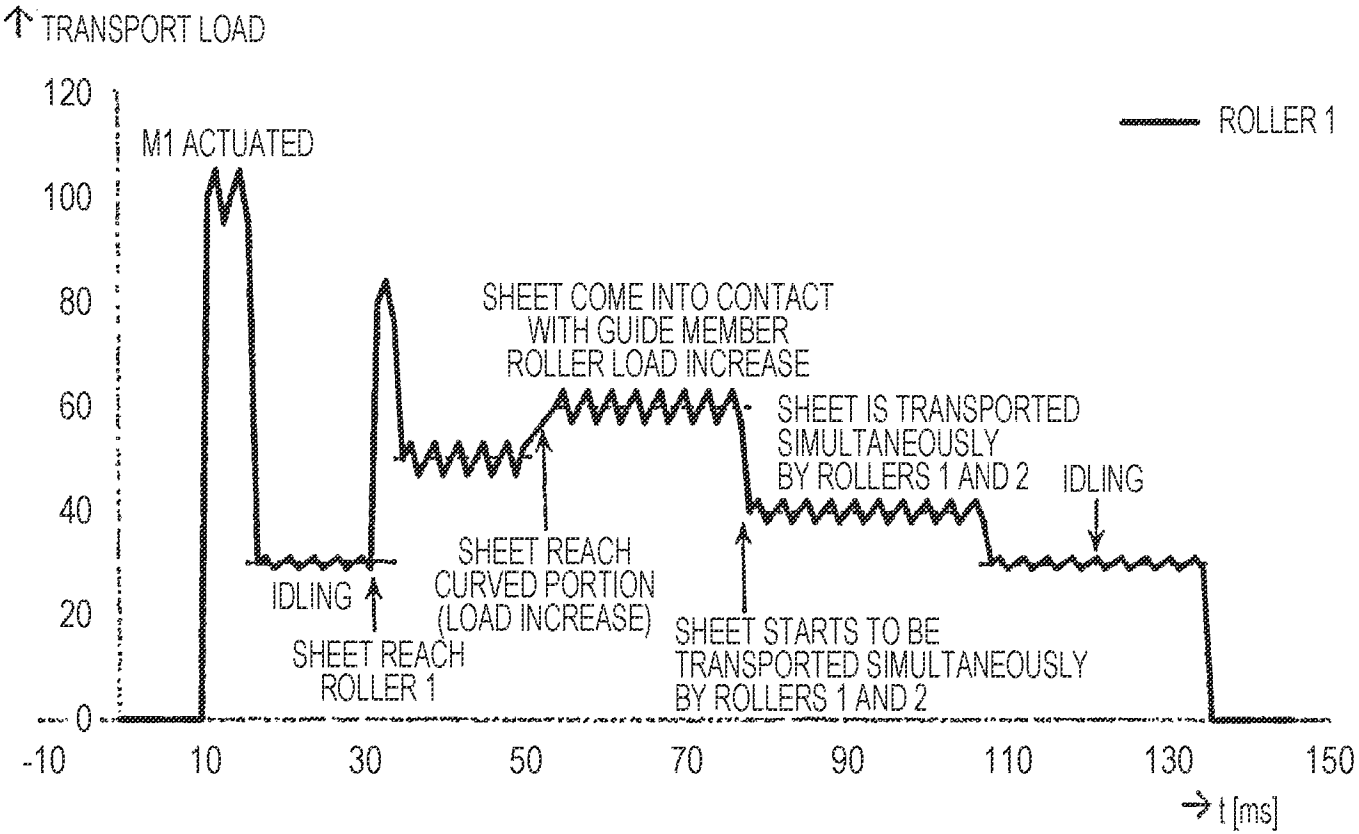
FIG. 8 is a graph showing changes in the load of the driving motor.

At this time, as shown in FIG. 6, the controller 100 detects the position of the leading end 5*a* of the recording sheet 5 by measuring the time elapsed from when the paper feeder 50 starts to feed the recording sheet 5 to when the leading end 5*a* of the recording sheet 5 is detected by a sheet sensor or the like (not shown) at a predetermined position (step 101).

When the controller 100 determines that the leading end 5*a* of the recording sheet 5 has passed through the paper-transport roller pair 53 and is located between the paper-transport roller pairs 53 and 54 (step 102 and 103), the controller 100 roughly adjusts the driving speed of the first driving motor 71 that drives the paper-transport roller pair 53 in accordance with the detection result obtained by the first load detector 73.

Rough Adjustment

The controller 100 controls the driving speed of the first driving motor 71 such that the load caused by the contact between the leading end 5*a* and intermediate region of the recording sheet 5 and the guide members 77 and 78 is within a predetermined range. More specifically, when the controller 100 determines that the load of the first driving motor 71 has increased from the detection result obtained by the first load detector 73 (step 104), the controller 100 reduces the driving speed of the first driving motor 71 (step 105) and then gradually increases the driving speed of the first driving motor 71 until a load fault is eliminated (step 106). The "load fault" is a situation in which the load of the first driving motor 71 drops below the lower limit of the predetermined range due to the reduction in the driving speed of the first driving motor 71.

The amount of increase in the torque, serving as the load, of the first driving motor 71, is calculated by the relational expression below:

The amount of increase in torque of driving motor= (torque during transportation at contact point)− (torque during transportation at position upstream of contact point)

The torque during transportation at contact point is the torque at the position where the recording sheet 5 is in contact with the guide members 77 and 78, and the torque during transportation at position upstream of contact point is the torque caused when the recording sheet 5 is transported at a position upstream of the contact point between the recording sheet 5 and the guide members 77 and 78.

Basically, the load of the first driving motor 71 increases due to the contact between the recording sheet 5 and the guide members 77 and 78 and varies with the area over which the recording sheet 5 is in contact with the guide members 77 and 78 or the magnitude of the contact pressure.

The load P caused by the contact between the recording sheet 5 and the guide members 77 and 78 is calculated by the relational expression below:

The load *P* on the guide members=(the amount of increase in torque of driving motor)/(coefficient of friction μ between the guide members and the recording sheet)

The coefficient of friction μ of the recording sheet 5, which determines the load P on the guide members, depends on the material, grammage, or the like of the recording sheet 5 and is automatically derived from the type of the recording sheet 5.

Hence, the controller 100 stores, in a storage part (not shown), a table of allowable amounts of increase in the torque of the driving motor, which determines the load P on the guide members, corresponding to the types of the recording sheets 5. The allowable amounts of increase in the torque of the driving motor may be stored either in the form of, for example, the load (current) on the driving motor or in the form of the amount of increase (in percentage) in the load (current) of the driving motor.

Basically, the load P on the recording sheet 5 is increased by the recording sheet 5 coming into contact with either of the guide members 77 and 78. The load P on the recording sheet 5 is decreased by the recording sheet 5 being separated from the guide members 77 and 78 or as a result of the contact area between the recording sheet 5 and the guide members 77 and 78 being reduced.

When the controller 100 determines that the load of the first driving motor 71 has decreased from the detection result obtained by the first load detector 73 (step 104), the controller 100 increases the driving speed of the first driving motor 71 (step 107) and then gradually reduces the driving speed of the first driving motor 71 until the load fault is eliminated (step 108).

Fine Adjustment

When the load (current)±XX A or the predetermined amount of increase (in percentage) of the load of the first driving motor 71 estimated from the type of the recording sheet 5 is exceeded, the controller 100 gradually reduces the speed of the first driving motor 71 until the change in the load becomes lower than the predetermined amount or to a predetermined speed V.

Figure 9A:
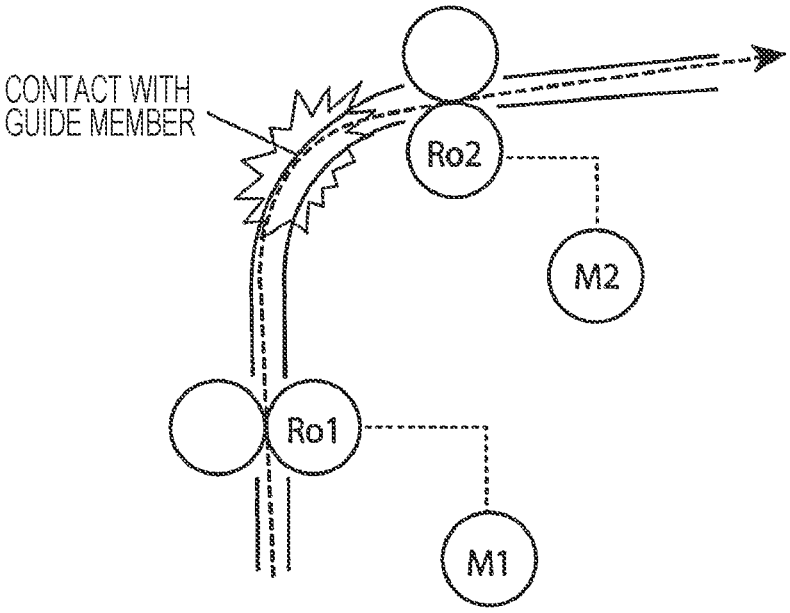
FIGS. 9A and 9B each show a transport state of a recording sheet.
Figure 9B:
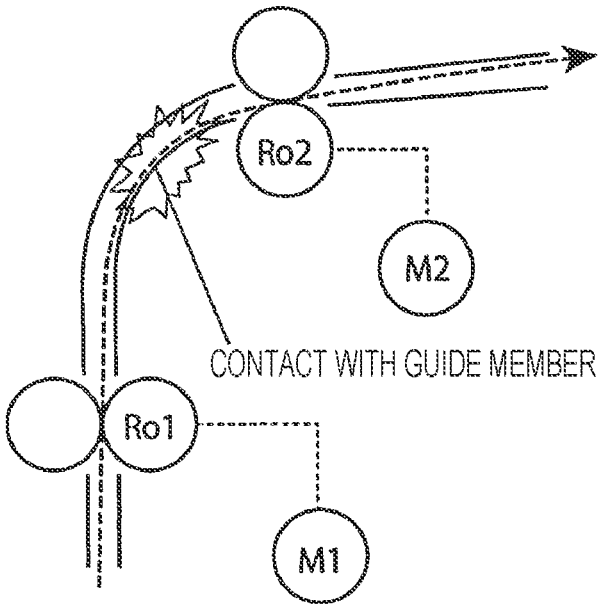

Meanwhile, as shown in FIGS. 9A and 9B, when the controller 100 determines that the leading end 5*a* of the recording sheet 5 has passed through the paper-transport roller pair 54, and the recording sheet 5 extends between the paper-transport roller pairs 53 and 54, the controller 100 roughly adjusts the driving speeds of the first and second driving motors 71 and 72 that drive the paper-transport roller pairs 53 and 54 on the basis of the detection results obtained by the first and second load detectors 73 and 74.

Rough Adjustment

Figure 10:
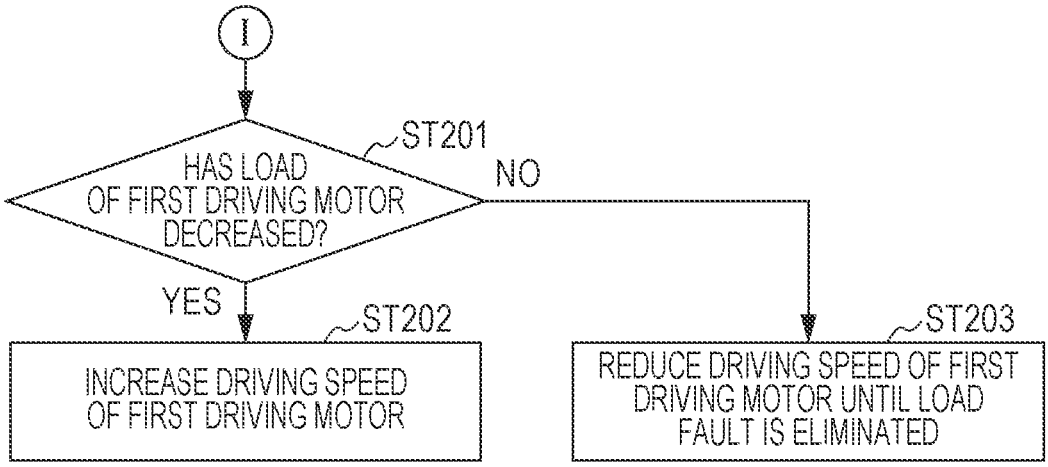
FIG. 10 is a flowchart showing an operation of the sheet transport device according to the first exemplary embodiment of the present disclosure.

As shown in FIG. 10, when the controller 100 determines, with the first load detector 73, that the load of the paper-transport roller pair 53 has decreased (step 201), the controller 100 increases the driving speed of the first driving motor 71 (step 202). When the controller 100 determines, with the first load detector 73, that the load of the paper-transport roller pair 53 has increased, the controller 100 gradually reduces the driving speed of the first driving motor 71 until the load fault is eliminated (step 203).

Figure 11:
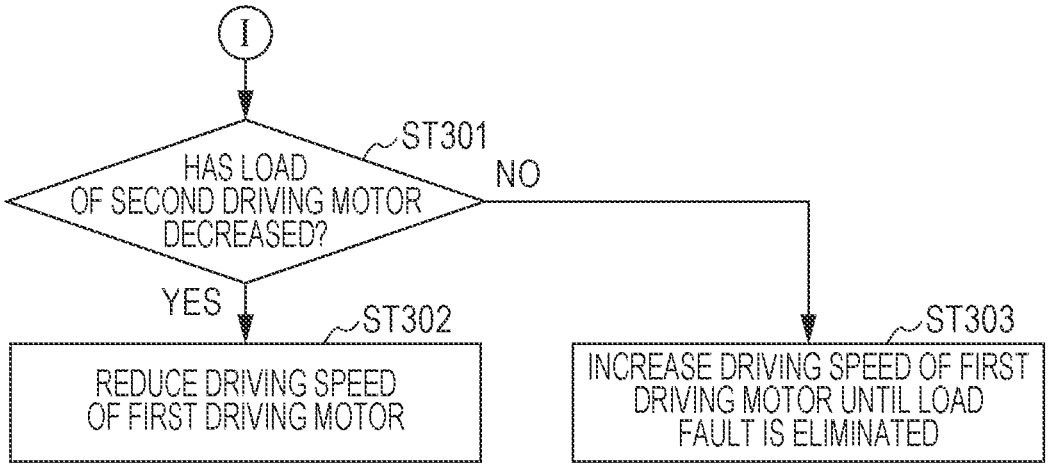
FIG. 11 is a flowchart showing an operation of the sheet transport device according to the first exemplary embodiment of the present disclosure.

Meanwhile, as shown in FIG. 11, when the controller 100 determines, with the second load detector 74, that the load of the paper-transport roller pair 54 has decreased (step 301), the controller 100 reduces the driving speed of the first driving motor 71 (step 302). When the controller 100 determines, with the second load detector 74, that the load of the paper-transport roller pair 54 has increased, the controller 100 gradually increases the driving speed of the first driving motor 71 until the load fault is eliminated (step 303).

Fine Adjustment

When the load (current)±XX A or the predetermined amount of increase (in percentage) of the load of the first driving motor 71 estimated from the type of the recording sheet 5 is exceeded, the controller 100 gradually reduces the speed of the first driving motor 71 until the change in the load becomes lower than the predetermined amount or to the predetermined speed V.

When the load (current)±XX A or the predetermined amount of increase (in percentage) of the load of the second driving motor 72 estimated from the type of the recording sheet 5 is exceeded, the controller 100 gradually reduces the speed of the second driving motor 72 until the change in the load becomes lower than the predetermined amount or to the predetermined speed V.

Figure 12:
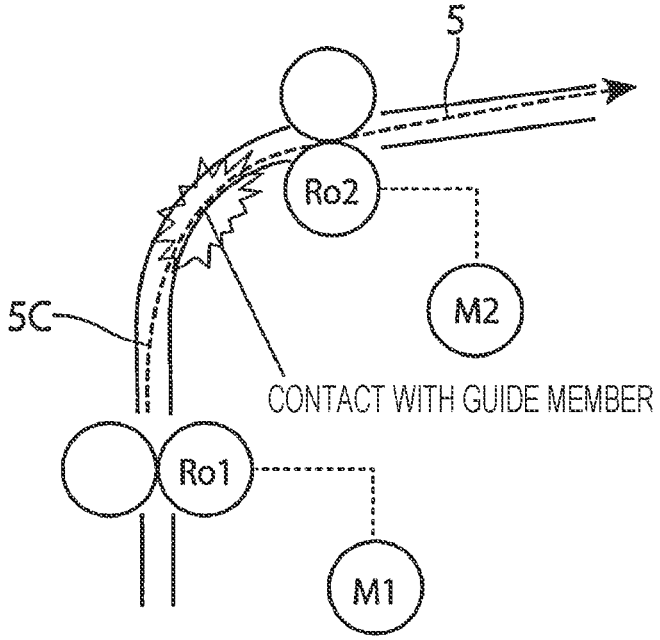
FIG. 12 shows a transport state of a recording sheet.

As shown in FIG. 12, when the controller 100 determines that a trailing end 5*c* of the recording sheet 5 has passed through the paper-transport roller pair 53 and not yet reached the paper-transport roller pair 54, the controller 100 roughly adjusts the driving speeds of the first and second driving motors 71 and 72 that drive the paper-transport roller pairs 53 and 54 on the basis of the detection results obtained by the first and second load detectors 73 and 74.

Rough Adjustment

When the controller 100 determines, with the second load detector 74, that the load of the paper-transport roller pair 54 has decreased, the controller 100 increases the driving speed of the first driving motor 71. When the controller 100 determines, with the second load detector 74, that the load of the paper-transport roller pair 54 has increased, the controller 100 gradually reduces the driving speed of the second driving motor 72 until the load fault is eliminated.

Fine Adjustment

When the load (current)±XX A or the predetermined amount of increase (in percentage) of the load of the second driving motor 72 estimated from the type of the recording sheet 5 is exceeded, the controller 100 gradually reduces the speed of the second driving motor 72 until the change in the load becomes lower than the predetermined amount or to the predetermined speed V.

Because the paper transport device 70 according to the first exemplary embodiment controls the driving speeds of the first and second driving motors 71 and 72 that drive the paper-transport roller pairs 53 and 54 in accordance with the position of the leading end 5*a* of the recording sheet 5, it is possible to suppress damage to the recording sheet 5 due to contact with the guide members 77, 78, and the like.

Second Exemplary Embodiment

Figure 13:
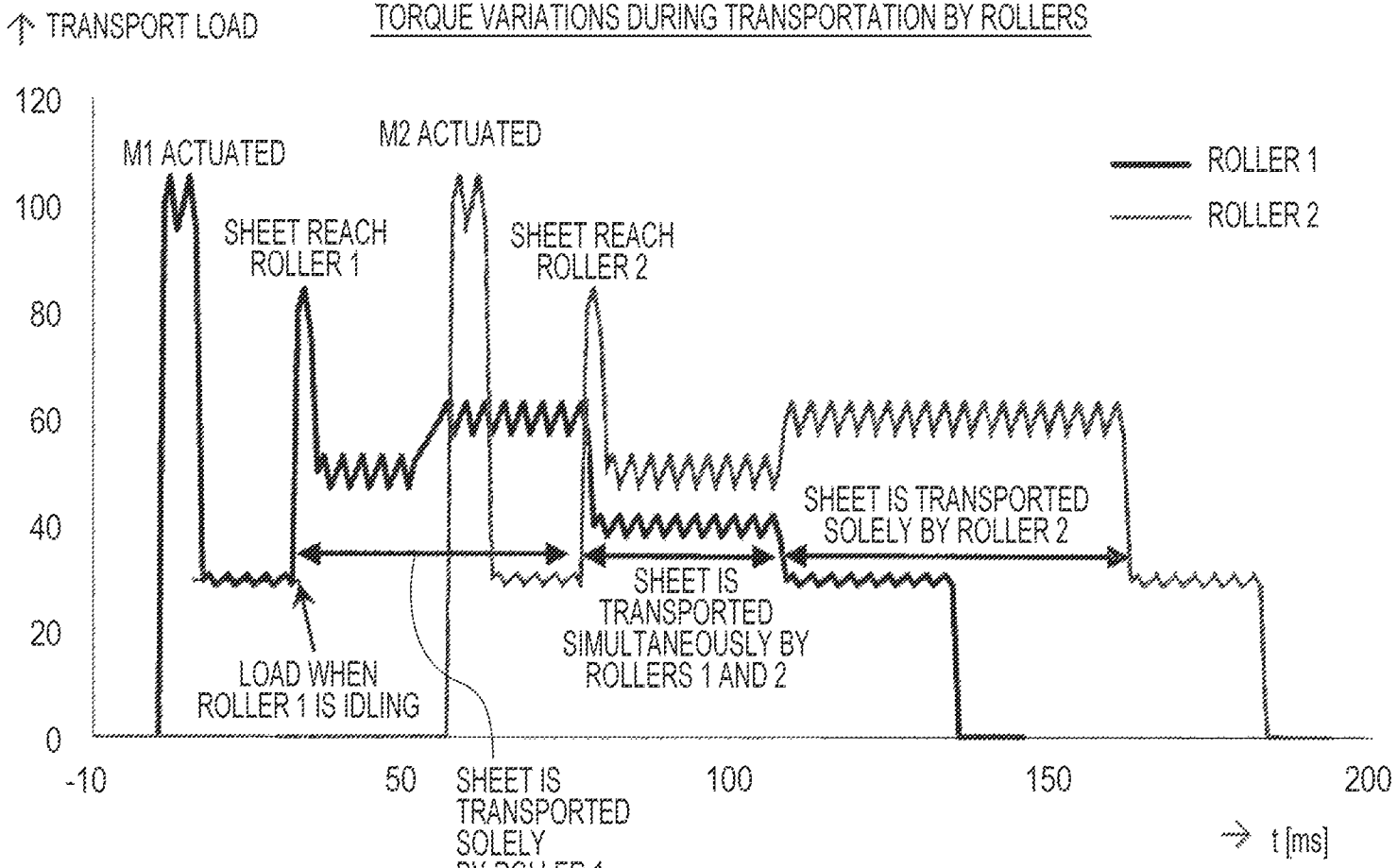
FIG. 13 is a graph showing changes in the loads of the driving motors.

FIG. 13 shows the overall configuration of an image forming apparatus that employs a sheet transport device according to a second exemplary embodiment of the present disclosure.

In the paper transport device according to the second exemplary embodiment of the present disclosure, the driving speeds of the first and second driving motors 71 and 72 that drive the paper-transport roller pairs 53 and 54 are not independently controlled in accordance with the position of the leading end 5*a* of the recording sheet 5. Instead, control is performed such that the difference between the loads of the first and second driving motors 71 and 72 satisfies a predetermined relationship.

In the paper transport device 70 according to the first exemplary embodiment, in which the driving speeds of the first and second driving motors 71 and 72 that drive the paper-transport roller pairs 53 and 54 are independently controlled, the driving speeds of the first and second driving motors 71 and 72 can be independently controlled to desired values such that the recording sheet 5 is not damaged. However, independently lowering the driving speeds of the first and second driving motors 71 and 72 relatively increases the time required to transport the recording sheet 5 along the feeding transport path 57, potentially lowering the production efficiency.

To counter this problem, as shown in FIG. 13, the paper transport device according to the second exemplary embodiment performs control such that the difference between the loads of the first and second driving motors 71 and 72 satisfies a predetermined relationship while the recording sheet 5 is transported by both of the paper-transport roller pairs 53 and 54.

The controller 100 controls the driving speeds of the first and second driving motors 71 and 72 such that the total amount of increase in the loads of the first and second driving motors 71 and 72 is minimum.

More specifically, when the current representing the load of the first driving motor 71 is higher than the current representing the load of the second driving motor 72, the controller 100 reduces the driving speed of the first driving motor 71, which is subjected to a relatively high load, so that the load of the first driving motor 71 is reduced. At this time, the controller 100 controls the driving speed of the second driving motor 72 such that the driving speed is maintained and is not decreased as much as possible. Desirably, the load of the first driving motor 71 is set to be higher than that of the second driving motor 72, so that the image side of the recording sheet 5 does not come into contact with the guide member 77.

Because the other configuration and operation are the same as those in the first exemplary embodiment, the explanation thereof will be omitted.

Third Exemplary Embodiment

Figure 14:
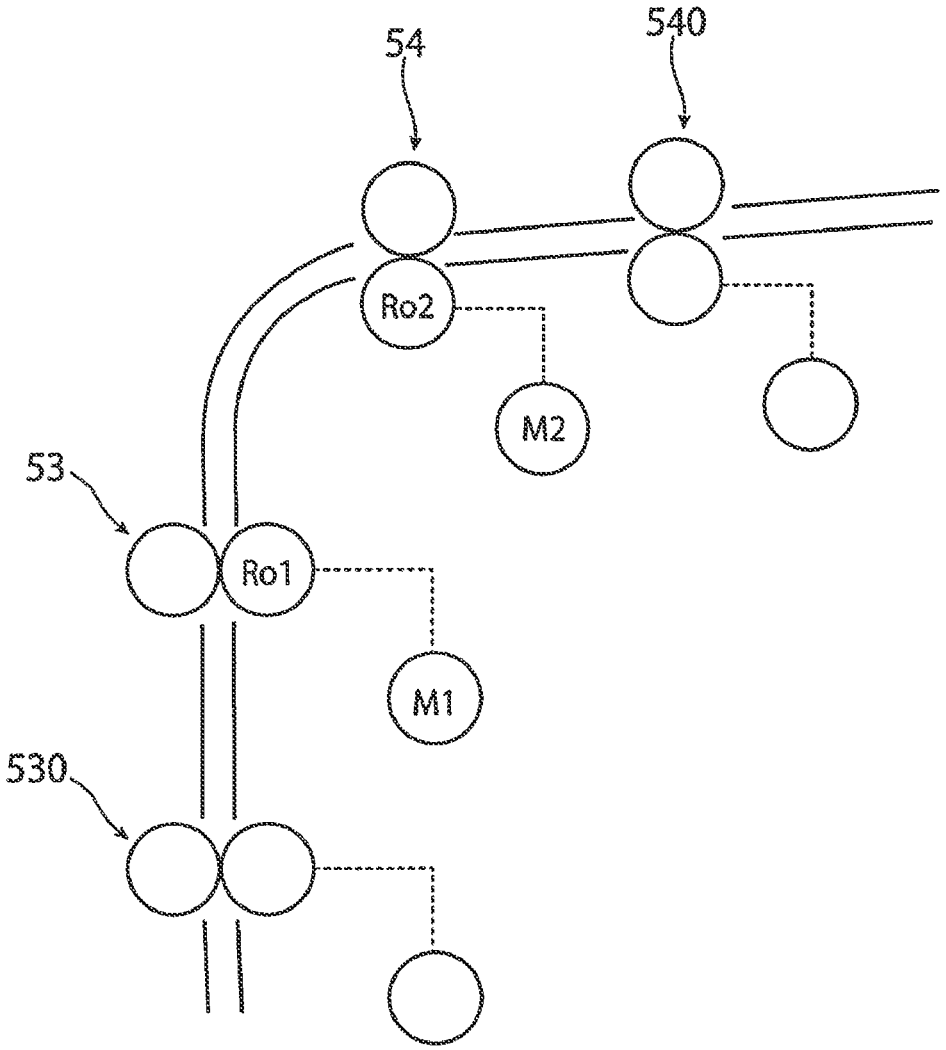
FIG. 14 shows the structure of a sheet transport device according to a second exemplary embodiment of the present disclosure.

FIG. 14 shows the overall structure of an image forming apparatus that employs a sheet transport device according to a third exemplary embodiment of the disclosure.

Although the paper transport devices according to the above-described exemplary embodiments have one paper-transport roller pair 53 and one paper-transport roller pair 54 in the curved section of the feeding transport path, it is of course possible to provide a paper-transport roller pair 530 on the upstream side of the paper-transport roller pair 53, and a paper-transport roller pair 540 on the downstream of the paper-transport roller pair 54.

In this case, the paper-transport roller pairs 53 and 530, which are located on the upstream side, may be controlled in the same way as the above-described paper-transport roller pair 53, and the paper-transport roller pairs 54 and 540, which are located on the downstream side, may be controlled in the same way as the above-described paper-transport roller pair 54.

Furthermore, when the leading end of the recording sheet 5 extends from the paper-transport roller pair 530 to the paper-transport roller pair 54 through the paper-transport roller pair 53, the paper-transport roller pairs 53 and 530 may be controlled in the same way as the above-described paper-transport roller pair 53, and the paper-transport roller pair 54, which is located on the downstream side, may be controlled in the same way as the above-described paper-transport roller pair 54.

Furthermore, when the leading end of the recording sheet 5 extends from the paper-transport roller pair 53 to the paper-transport roller pair 540 through the paper-transport roller pair 54, the paper-transport roller pair 53 may be controlled in the same way as the above-described paper-transport roller pair 53, and the paper-transport roller pairs 54 and 540, which are located on the downstream side, may be controlled in the same way as the above-described paper-transport roller pair 54.

Because the other configuration and operation are the same as those in the first exemplary embodiment, the explanation thereof will be omitted.

Fourth Exemplary Embodiment

Next, an image forming apparatus that employs a sheet transport device according to a fourth exemplary embodiment of the disclosure will be described.

The paper transport device according to the fourth exemplary embodiment includes a notification part that issues a notice when the control unit determines that there is a risk of damage to a sheet on the basis of the results of detection of the loads of the multiple driving sources.

In the paper transport device according to the fourth exemplary embodiment, whether to enable the notification operation of the notification part can be selected.

Specifically, as shown in FIG. 1, in the paper transport device according to the fourth exemplary embodiment, the controller 100 issues a notice by displaying, on a user interface, a notice to the effect that there is a risk of damage to the recording sheet 5.

The recording sheet 5 may be damaged when, during the above-described control operation, the driving speed of the first driving motor 71 decreases to the lower limit of the predetermined range, and this state lasts for a predetermined period of time, or when, during the above-described control operation, the difference between the amounts of increase in the load of the first and second driving motors 71 and 72 exceeds a certain value, and this state lasts for a predetermined period of time.

A user can enable or disable indication of a notice on the user interface.

Because the other configuration and operation are the same as those in the first exemplary embodiment, the explanation thereof will be omitted.

Although the image forming sections in the above-described exemplary embodiments electrophotographically form images, the image forming sections may of course form images by an ink jet recording method.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet transport device comprising:
- a curved sheet transport path;
- a plurality of transport roller pairs disposed in the sheet transport path;
- a plurality of driving sources that drive the plurality of transport roller pairs;
- a plurality of load detectors that detect the loads of the plurality of driving sources; and
- a control unit that:
  - controls a driving speed of at least one of the driving sources such that detection results obtained by the load detectors are within a predetermined range, and
  - controls to adjust the driving speed of the at least one of the driving sources based on a result of a comparison of the load of at least two of the driving sources.

2. The sheet transport device according to claim 1, wherein the control unit controls the driving speeds of the driving source on the upstream side and the driving source on the downstream side in the sheet transport direction.

3. The sheet transport device according to claim 2, wherein the control unit is configured to operate in a first mode in which the driving speed of the driving source on the upstream side in the sheet transport direction is reduced, and in a second mode in which the driving speed of the driving source on the downstream side in the sheet transport direction is increased.

4. The sheet transport device according to claim 1, wherein:
- the sheet transport path includes a pair of curved guide members that guide the front and back surfaces of the sheet; and
- the plurality of transport roller pairs include a pair disposed upstream of and a pair disposed downstream of the curved guide members.

5. The sheet transport device according to claim 4, wherein the control unit performs different control depending on whether a leading end of the sheet is located in front of or behind the transport roller pair on the downstream side.

6. The sheet transport device according to claim 1, further comprising a notification part that issues a notice when the control unit determines that there is a risk of damage to the sheet from the detected loads of the plurality of driving sources.

7. The sheet transport device according to claim 6, wherein whether to enable a notification operation of the notification part can be selected.

8. An image forming apparatus comprising:
- an image forming section that forms an image on a recording medium; and
- a transport section that transports the recording medium to the image forming section, the transport section including the sheet transport device according to claim 1.

9. An image forming apparatus comprising:
- an image forming section that forms an image on a recording medium; and
- a transport section that transports the recording medium to the image forming section, the transport section including the sheet transport device according to claim 2.

10. An image forming apparatus comprising:
- an image forming section that forms an image on a recording medium; and
- a transport section that transports the recording medium to the image forming section, the transport section including the sheet transport device according to claim 3.

11. An image forming apparatus comprising:
- an image forming section that forms an image on a recording medium; and
- a transport section that transports the recording medium to the image forming section, the transport section including the sheet transport device according to claim 4.

12. An image forming apparatus comprising:
- an image forming section that forms an image on a recording medium; and
- a transport section that transports the recording medium to the image forming section, the transport section including the sheet transport device according to claim 5.

13. An image forming apparatus comprising:
- an image forming section that forms an image on a recording medium; and
- a transport section that transports the recording medium to the image forming section, the transport section including the sheet transport device according to claim 6.

14. An image forming apparatus comprising:
- an image forming section that forms an image on a recording medium; and
- a transport section that transports the recording medium to the image forming section, the transport section including the sheet transport device according to claim 7.

15. The sheet transport device according to claim 1, wherein the control unit controls to reduce the speed of one of the driving sources with a load that is heavier than another driving source.

16. A sheet transport device comprising:
- a curved sheet transport path;
- a plurality of transport roller pairs disposed in the sheet transport path;
- a plurality of driving sources that drive the plurality of transport roller pairs;
- a plurality of load detecting means for detecting the loads of the plurality of driving sources; and
- control means for (i) controlling a driving speed of at least one of the driving sources such that detection results obtained by the load detecting means are within a predetermined range, and (ii) controlling to adjust the driving speed of the at least one of the driving sources based on a result of a comparison of the load of at least two of the driving sources.

* * * * *